US005846003A

United States Patent [19]

Mori et al.

[11] Patent Number: 5,846,003

[45] **Date of Patent: *Dec. 8, 1998**

[54] THERMAL PRINTER HAVING AN ELASTIC PRINT HEAD SUPPORT

[75] Inventors: Yukihiro Mori, Iiyama, Japan; Sumio Watanabe, Hoofddorp, Netherlands

[73] Assignee: Fujitsu Takamisawa Component Limited, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 851,534

[22] Filed: May 5, 1997

[30] Foreign Application Priority Data

May 9, 1996 [JP] Japan ..... 8-114649

[51] Int. Cl.[6] ..... B41J 2/315

[52] U.S. Cl. ..... 400/120.17; 400/355; 347/198

[58] Field of Search ..... 400/120.16, 120.17, 400/174, 175, 355; 347/197, 198

[56] References Cited

U.S. PATENT DOCUMENTS

| | | | |
|---|---|---|---|
| 4,626,873 | 12/1986 | Kotani et al. . | |
| 5,072,238 | 12/1991 | Takamiya et al. | 400/120.17 |
| 5,156,467 | 10/1992 | Kitahara et al. | 400/120.17 |
| 5,422,660 | 6/1995 | Oikawa | 347/198 |

FOREIGN PATENT DOCUMENTS

| | | | |
|---|---|---|---|
| 0 392 213 | 10/1990 | European Pat. Off. . | |
| 01888164 | 8/1986 | Japan | 400/120.17 |
| 0008056 | 1/1989 | Japan | 400/120.17 |

OTHER PUBLICATIONS

Patent Abstracts of Japan, vol. 012, No. 078 (M–675), Mar. 11, 1988; abstract of JP 62 218146 A (Seiko Instr & Electronics Ltd), Sep. 25, 1987.

Patent Abstracts of Japan, vol. 016, No. 384 (M–1296), Aug. 17, 1992; abstract of JP 04 125174 A (toshiba Corp), Apr. 24, 1992.

*Primary Examiner*—John S. Hilten
*Attorney, Agent, or Firm*—Staas & Halsey

[57] ABSTRACT

A thermal head, rotatably supported by a supporting shaft parallel to the shaft of a platen, is resiliently pressed by an elastic member, such as a sheet spring, and comes into contact with the platen. A pair of arm members are provided on either side of the platen, the arms having through holes which allow for rotatably fitting and supporting therein the platen shaft. A bar member for receiving a resilient force of the elastic member is linked to other ends of the arm members, passing across the space between the arm members. The bar member is relieved from contact with the elastic member by rotating at least one of the arm members around the platen shaft or by moving at least one end of the bar member in a direction away from the platen. In the latter case, a crank mechanism is used for changing the effective length of one of the arm members. The thermal printer is compact and light, has high printing reliability, and facilitates ease in maintenance and replacement of the thermal head.

27 Claims, 10 Drawing Sheets

THERMAL PRINTER HAVING AN ELASTIC PRINT HEAD SUPPORT

BACKGROUND OF THE INVENTION

1. Field of the Invention

The present invention relates to a thermal printer, and particularly to a thermal printer provided with a line-dot thermal head which is capable of one-line-at-a-time printing of dots in a line.

In recent years, the widespread use of personal computers has resulted in demand for printers as information output apparatuses. Thermal printers are advantageous compared to printers based on other principles in that miniaturization thereof is simple, the printing speed thereof is relatively fast, the noise thereof is low, and so forth. Further, thermal printers are advantageous in being maintenance-free for long periods of time.

Of the various types of thermal printers, so-called line dot printers which use a plurality of heat-generating devices arrayed in the row direction so as to enable line-at-a-time printing of the dots of one line or a plurality of lines do not require a mechanism for scanning the printer head in a row direction, and therefore is suitable for usages wherein further miniaturization, weight reduction, and cost reduction are required. Examples of such usage include the following: portable data processing equipment used for meter-reading operations for water, gas, and the like, POS (point-of-sales) terminals, and facsimile output printers.

On the other hand, with these applications as well, it is required that the thermal printer have high reliability in printing, and that exchanging of the thermal head be simple, in addition to miniaturization, weight reduction, and cost reduction.

2. Description of the Related Art

FIG. 8A and FIG. 8B are respectively a perspective view and a cross-sectional view of an example of a prior art line-dot thermal printer, and FIG. 9A and 9B are side views of this prior art example respectively illustrating the head-down state, wherein the thermal head is in contact with the platen, and the head-up state, wherein the thermal head is not in contact with the platen.

In the Figures, reference numeral 10 denotes a chassis formed integrally of plastic molding. The chassis 10 further comprises a pair of side walls 11 which face, or oppose, one another. The chassis 10 is made to be as thin as possible for purposes of miniaturization and lightening. The platen 2 has a structure of a metal core being covered with an elastic material such as rubber or the like, and rotates around a central shaft 21. Both ends of the shaft 21 are supported rotatably by bearings (not shown) provided respectively to the aforementioned pair of side walls 11 of the chassis 10.

By rotating the platen 2, either continuously or intermittently, paper 5 is fed between the platen 2 and a thermal printing type print head (hereafter referred to as "thermal head") 3, and, e.g., heat-sensitive paper 5 directly exhibits coloring due to the heat of the thermal head 3. In this process, the thermal head 3 is controlled so as to perform printing operation (supplying electrical power to the proper heat-generating elements in the case of line-printing type) synchronously with the amount of feed of the paper 5 of the pitch thereof.

On the outer side of one of the side walls 11 of the chassis 10 is provided a mechanism for rotating the platen 2, such as a gear box 19 with gears (not shown) built in. One end of the shaft 21 of the platen protrudes into the interior of the gear box 19. The platen 2 is rotated by either continuously or intermittently driving this edge portion with a motor 6 through gears.

The thermal head 3 includes a plate member 30 which has a main surface parallel to the shaft 21 of the platen 2. The plate member 30 is comprised of a thermal-conducting material such as aluminum, for example, supports the thermal assembly which includes the aforementioned heat-generating elements, and also promotes cooling of the heated heat-generating elements. The lower portion of the plate member 30 is supported so as to be rotatable centrally around an axis extending parallel to the shaft 21 of the platen 2. Accordingly, for example, there is a groove provided following the lower edge of the plate member 30, and the supporting shaft 32 fits in this groove on the aforementioned axis.

The thermal head 3 comprises a structure of several hundred or several thousand minute dots of heat-generating elements arrayed on, e.g., the surface of a ceramic substrate, in a direction perpendicular to the scanning direction of the paper 5, these heat-generating elements having been formed by means of thick-film formation process or thin-film formation process. Such a substrate 31 is fixed to the front surface of the plate member 30, i.e., the surface which comes in contact with the platen 2.

The thermal head 3 supported by the supporting shaft 32 parallel with the platen shaft 21 is arranged such that all of the aforementioned heat-generating elements come into contact with the outer perimeter of the platen 2 when the thermal head 3 is rotated in the direction of the platen 2. This state is referred to as "head-down", and enables line-dot printing.

Reference numeral 7 denotes a flexible cable for connecting the thermal head 3 and the controller of a device which uses the thermal head 3 as an information output apparatus, such as portable data processing equipment used for meter-reading or POS terminals. Electrical power and control signals for driving the thermal head 3 are sent to the thermal head 3 via the flexible cable 7. An inner wall 12 is provided within the chassis 10, perpendicular to the side walls 11 and in the space opposite to the platen 2, regarding the plate member 30. An elastic member 4 is provided between this inner wall 12 and the plate member 30.

The elastic member 4 exerts a resilient force, pressing the thermal head 3 against the platen 2, and is formed of, e.g., a metal sheet spring folded in a U-shape. One edge of this elastic member 4, denoted by 4A comes into contact with the rear side of the thermal head 3, or, more precisely, the rear side of the plane of the plate member 30, to which plane the aforementioned substrate 31 having heat-generating elements formed thereon is fixed. The end 4A of the elastic member 4 has a shape such that it is spread, or spaced, along the shaft 21 of the platen 2. According to this structure, when in the head-down state, all of the heat-generating elements come into contact with the platen with an even contact pressure. This is in order to avoid poor quality printing, otherwise arising due to uneven contact pressure, such as irregularities in printing density and partial blank spots.

On the other hand, the other edge of this elastic member 4, denoted by 4B, is worked to a narrow width, and comes into contact with the inner wall 12 provided within the chassis 10. Accordingly, the inner wall 12 is perpetually subjected to the resilience of the elastic member 4, i.e., pressure in the opposite direction of the pressure placed upon the thermal head 3. The elastic member 4 is fixed to either the thermal head 3 or inner wall 12 by the edge 4A or the edge 4B, respectively, by means of a screw or by an adhesive agent.

As can be understood from the cross-sectional views in FIG. 8B and FIG. 9B, a guide member 14 of a cylindrical surface following the outer periphery of the platen 2 is provided at a position below the platen 2 in the chassis 10 for guiding the paper 5.

With a thermal printer constructed as described above, the thermal head 3 is pressed against the platen 2 by an elastic member 4, so it is necessary to remove the thermal head 3 away from the platen 2 against the pressure of the elastic member 4 when setting new paper 5 or removing jammed paper 5. This is the head-up state. After the thermal head 3 is made to be in the head-up position, paper 5 is fed between the guide member 14 and the platen 2 by hand from the rear side of the chassis 10, and the platen 2 is rotated manually. After the leading edge of the paper 5 is inserted between the platen 2 and the thermal head 3, the thermal head 3 is returned to the head-down state. Accordingly, the thermal head 3 comes into contact with the platen 2 via the paper 5.

As for a method for producing the head-up state of the thermal head 3, a simple method is to press a portion close to the upper edge of the plate member 30 toward the inner wall 12 e.g., by finger. However, this method is not favorable from the point of ergonomics, since the resilience of the elastic member 4 is strong, and great pressure is placed on the finger tip. Thus, as shown in FIG. 8A, FIG. 9A, and FIG. 9B, head-up means using a cam mechanism 70 are used.

This head-up means is comprised of a pin 35 provided so as to protrude from the side of the portion close to the upper edge of the plate member 30, and a cam mechanism 70 provided to the outer side of the side wall 11. The cam mechanism 70 is comprised of a round plate formed main member and a cam 71 and lever 72 protruding from this round plate member in the peripheral direction. For example, the shaft 21 of the platen 2 is made to fit into a hole provided to the center of the round plate formed main member of the cam mechanism 70, and the cam mechanism 70 is attached to the shaft 21 so as to be rotatable. The round plate formed main member is rotated by the lever 72, and pressure is applied to the pin 35 by the perimeter edge of the cam 71. As a result of the head-up operation, the plate member 30 is rotated in a direction away from the platen 2, and the thermal head 3 is removed, or displaced, from the platen 2.

As described above, as shown in FIG. 8A through FIG. 9B, with prior art thermal printers, the thermal head 3 is pressed against the platen 2 by means of an elastic member 4 inserted between the inner wall 12 of the chassis 10 and the plate member 30, so that resilience (i.e., the resilient force) of the elastic member 4 is applied to the inner wall 12. On the other hand, the pressure placed upon the platen 2 through the thermal head 3 is placed upon the side walls 11 via the shaft 21. Accordingly, the side walls 11 and inner wall 12 of the chassis 10 must be of strength sufficient to withstand this pressure, and accordingly, the thickness of the inner wall 12 of the chassis 10 must be sufficiently great, thereby limiting weight reduction.

As described above, the form of the elastic member 4 takes into consideration placing uniform contact pressure on the platen 2 with all of the heat-generating elements of the thermal head 3. Accordingly, in the head-down state, the pressure of the elastic member 4 is equally placed upon the bearings (not shown) supporting the shaft 21 of the platen 2 and both side walls 11 to which these bearings are fixed.

However, in the state of head-up, i.e., in the head-up state in which the pin 35 provided to one side of the plate member 30 is pressed by the cam mechanism 70, the pressure to the inner wall 12 becomes uneven. This is because that when the pin 35 is pressed by the cam mechanism 70 in order to place the thermal head 3 in the head-up state, greater stress is placed on the portions of the elastic member 4 closer to the cam mechanism 70 due to the greater deformation thereof. As a result, the chassis 10 itself twists in an attempt to ease this great stress. Specifically, the bottom plate and inner wall 12 of the chassis 10 twist in such a manner that one of the side walls 11 to which the gear box 19 is not provided rotates parallel to the other of the side walls 11 to which the gear box is provided.

If the time duration of the head-up state is short, this twisting will return to the original state. Accordingly, there is no change to the uniformity of the pressure to the plate member 30, and as a result, such temporary twisting of the chassis 10 has practically no effect on printing quality. However, with thermal printers, the thermal head 3 is maintained in the head-up state except for intervals of printing, in order to avoid deformation of the rubber of the platen 2. For example, the thermal head 3 is maintained in the head-up state for long periods of time such as when shipping of the thermal printer, during the night, or on non-business days. As a result, the twisted chassis 10 does not return to the original form even when placed in the head-down state, causing a problem that, in the worst cases, irregular printing results.

Accordingly, in order to prevent such twisting, the entire chassis 10, including the bottom plate, must be made thick, not only the side walls 11 and inner wall 12, making it even more difficult to realize reduction in the weight of the chassis 10.

Further, with prior art thermal printers as described above, the elastic member 4 is constantly placing pressure on the thermal head 3 and the inner wall 12, regardless of whether the thermal head 3 is in the head-up position or the head-down position. Accordingly, there has been a problem in this arrangement on that it is difficult to remove the thermal head 3 from the chassis 10 for inspection or replacement of the thermal head 3.

Disclosed in Japanese Laid-open Patent Publication No. 8-90870 (disclosed on Apr. 9, 1996) is a mechanism wherein a pressurizing spring, provided to the rear of a line thermal head, is pressed by means of a pressing cam, thus causing the line thermal head to come into contact with the platen. This pressing cam is fixed to a head-release shaft rotatably supported by a side frame. Accordingly, the pressure can be disengaged by means of rotating the head-release shaft. In this structure also, the members supporting the head-release shaft and the platen must be of a strength which will not deform due to the pressure and resilience of the pressurizing spring and have a greater weight. However, the prior art makes no mention regarding decreasing weight increased by preventing deforming of the members.

SUMMARY OF THE INVENTION

Accordingly, it is an object of the present invention to provide a thermal printer which has high reliability in the printing quality thereof and yet is compact and light.

It is another object of the present invention to provide means for performing head-up of a thermal head without causing twisting of the chassis.

It is yet another object of the present invention to provide a thermal printer which will not develop deterioration in printing quality owing to twisting of the chassis even after long periods of non-use.

It is a further object of the present invention to provide a thermal printer wherein maintenance and replacement of the thermal head is simple.

In order to achieve the above objects, the present invention provides a thermal printer, comprising a chassis, further comprising a pair of side walls; a platen having a first axis which is supported by bearing means provided to the forementioned side walls; a thermal head which is rotatable around a second axis parallel to the first axis, thereby supporting the thermal head so as to allow contact thereof with the platen; a spring which serves as a means for applying a resilient force to the platen so that this thermal head comes in contact with the platen at a pressure corresponding the resilient force, and has one end coming into contact with the rear plane of the thermal head, and another end which is supported by the aforementioned one end; and means for receiving the resilient force of this spring, provided separately from the aforementioned side walls and supported by the aforementioned first axis, including the portion extending to the rear plane of the thermal head, so as to come into contact with the other end of the aforementioned spring for receiving the resilient force.

Further, the present invention provides a thermal printer, further comprising additional means for freeing the member serving as means for receiving the resilience of the forementioned spring, from contact with the other end of the spring.

DESCRIPTION OF THE PREFERRED EMBODIMENTS

Figure 1:
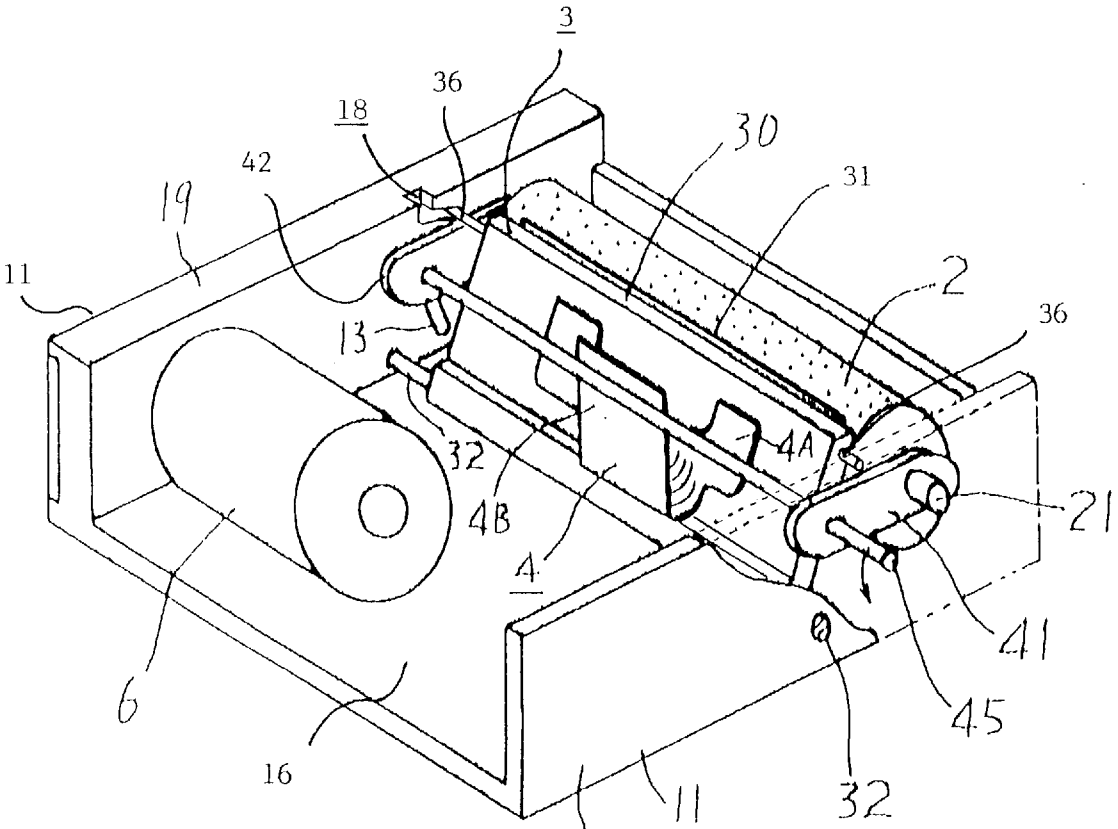
FIG. 1 is an overall perspective view for describing a first embodiment of the present invention.

The present invention will now be described in detail with reference to the drawings. The reference numerals which are common to all of the drawings indicate items which are the same in all.

With reference to FIG. 1, the thermal printer according to the present invention has a chassis 10 which has been formed from plastic for the purpose of reduction of weight. The chassis 10 has one pair of opposing side walls 11, is of a box-form with the top portion open, and is integrally formed by molding. A platen 2 is provided within the chassis 10 so as to be rotatable around a first shaft 21. The shaft 21 is supported by bearings mounted in the pair of side walls 11. Provided within the chassis 10 is a thermal head 3 which is supported rotatably by a second shaft, i.e. a supporting shaft 32 parallel with the shaft 21. The supporting shaft 32 may be a relatively long rod spanning the space between the pair of side walls 11, or may be relatively short pins provided so as to project from the respective side walls 11.

The thermal head 3 includes a plate-shaped plate member 30 formed of aluminum of several mm in thickness, for example, and a bearing mechanism is provided on the lower edge of the plate member 30 in which the supporting shaft 32 fits. Depending on the form of the supporting shaft 32, this bearing mechanism may be an elongated hole formed in the plate member 30 and extending from one side to another side thereof, a pair of hollows, or recesses, formed in the spaced sides, i.e., one in each side, or a structure wherein a separate member such as plate-shaped members having through holes formed therein are fixed to both edges of the lower side of the plate member 30 so as to allow passage of the supporting shaft 32 therethrough. In order to allow the thermal head 3 to be removed from the printer proper, structures may be used such as a half-cylindrical groove, formed in the bottom surface of the plate member 30, or a notch formed in the lower portion of the aforementioned plate-formed members.

A structure may also be used wherein, instead of the aforementioned shaft 32 or pins protruding from the side walls 11, pins projecting in the direction in parallel to the shaft 21 are provided at both sides of the plate member 30 and are supported by a bearing mechanism provided in each of the side walls 11 or affixed to the bottom plate 16 of the chassis 10.

The plate member 30 is rotatable centrally around the supporting shaft 32, and the thermal head, mounted on one planar surface of the plate member 30, is arranged so as to be moveable into contact with the platen 2. An elastic member 4 comprised of a U-shaped sheet spring, for example, is disposed at the rear side of the plate member 30. The elastic member 4 is formed of a sheet spring and has one end 4A, which is fixed to the rear side of the plate member 30, and an opposite, or second, end 4B. The end 4B comes into contact with a bar member 45, for example, which is a constituent of a later described resilient force receiving element according to the present invention. The one end 4A of the elastic member 4 is forked near the end thereof, and the other end 4B is formed so as to be narrow. According to such a structure, the distribution of pressure in the contact area between the thermal head 3 and the platen 2 is made to be uniform. Also, as other forms of the elastic member 4, Z-shaped sheet springs or coil springs may be used, instead.

Pins 36 are respectively fixed at the upper portions of both sides of the plate member 30, extending in parallel with the shaft 21 of the platen 2. Grooves 18 are provided on both side walls 11 of the chassis 10 for the corresponding pins 36 to engage slidably.

Each of the grooves 18 may have a structure passing through the corresponding side walls 11, or may be hollow, i.e., recesses, in the walls. The grooves 18 are formed of a circular arc groove 18A which is centered around the supporting shaft 32 and has a radius which is the same as the distance between the supporting shaft 32 and pins 36, and a straight groove 18B which connects to the circular arc groove 18A and extends to the upper end of the side walls 11. The straight groove 18B is provided on a line which perpendicularly intersects the supporting shaft 32 and pins 36 in the state wherein the bar member 45 is removed from contact with the other end 4B of the elastic member 4, i.e., in the head-up state of the thermal head 3.

In the head-down state of the thermal head 3, contacting with the platen 2 and owing to pressure (i.e., the resilient force) from the elastic member 4, the thermal head 3 receives slippage friction due to the rotating platen 2. Consequently, the thermal head 3 attempts to move toward the upper side of the chassis 10. Such movement of the thermal head 3 is prevented by the circular arc grooves 18A and the pins 36 fitting thereto. On the other hand, when the pressure of the elastic member 4 is disengaged, and the thermal head 3 is set in the head-up position (state), the pins 36 are situated at the point of intersection of the circular arc grooves 18A and the respective straight grooves 18B. Accordingly, the thermal head 3 can be removed from the supporting shaft 32 and extracted from the chassis 10 by moving the thermal head 3 upwards by sliding the pins 36 through the straight grooves 18B.

The resilient force receiving element is comprised of a pair of arm members 41 and 42 positioned on the shaft 21 at either side of the platen 2, for example, and the aforementioned bar member 45. Each of the arm members 41 and 42 has a first portion 41*a*, 41*b* in which is provided a through hole which is rotatably received on and fits the shaft 21, and a second portion 42*a*, 42*b* opposing the first portion. The bar member 45 is linked to the second portions by extending between and being inserted at the opposite ends thereof into the second portions of the respective arm members 41 and 42.

In the state that the bar member 45 comes into contact with the elastic member 4 and the elastic member 4 presses the plate member 30, i.e., the printing head 3, so as to come into contact with the platen 2, this pressure (force) is transmitted to the shaft 21 of the platen 2. On the other hand, the resilient force of the elastic member 4 is applied to the bar member 45, and is transmitted to the shaft 21 of the platen 2 via the arm members 41 and 42. Accordingly, the pressure and resilient force due to the elastic member 4 is balanced within the system comprised of the printing head 3, platen 2, shaft 21, bar member 45, and arm members 41 and 42.

Figure 8A:
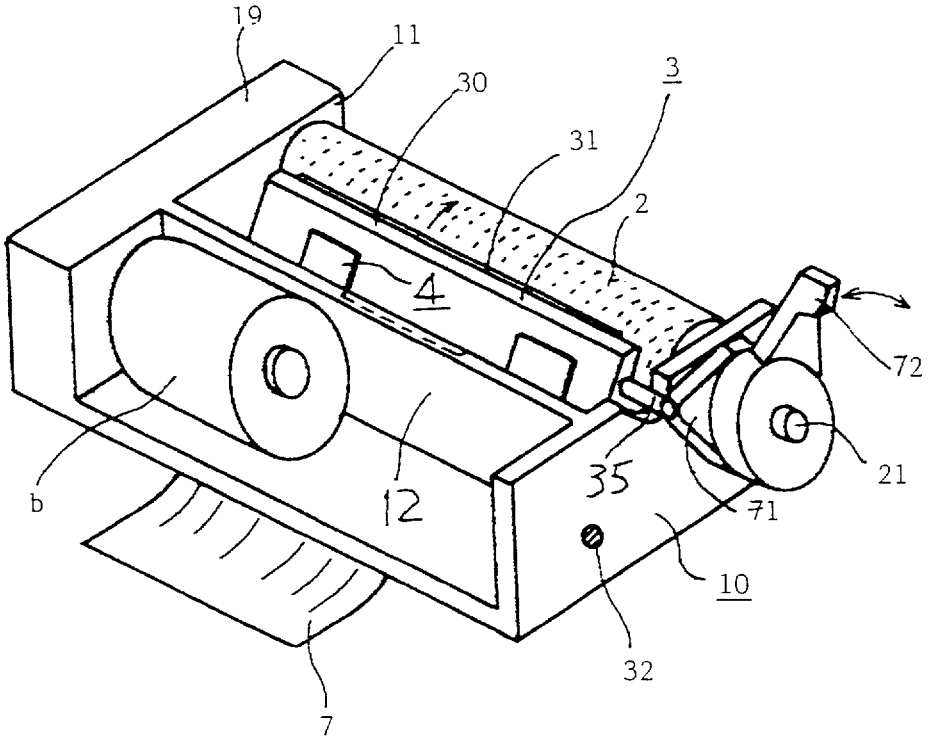
FIG. 8A PRIOR ART
FIG. 8A and FIG. 8B are respectively an overall perspective view and a cross-sectional view of a prior art thermal printer.
Figure 8B:
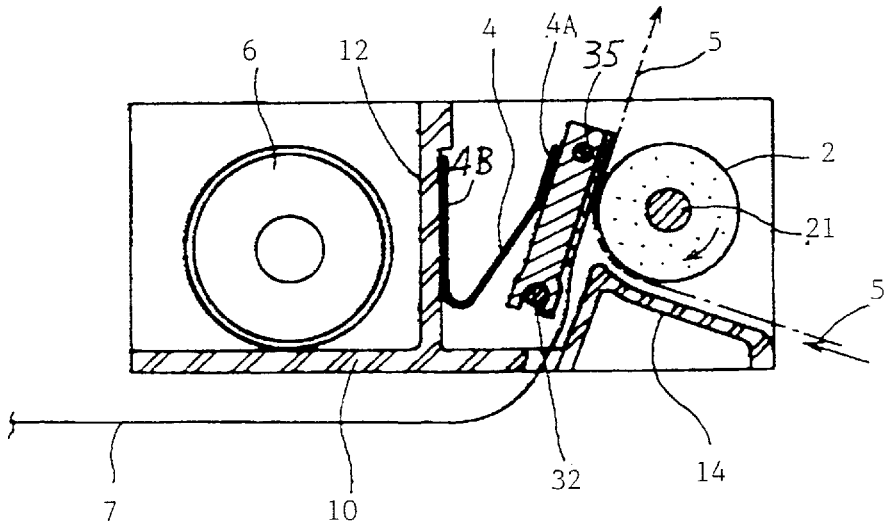
FIG. 8B PRIOR ART
Figure 9A:
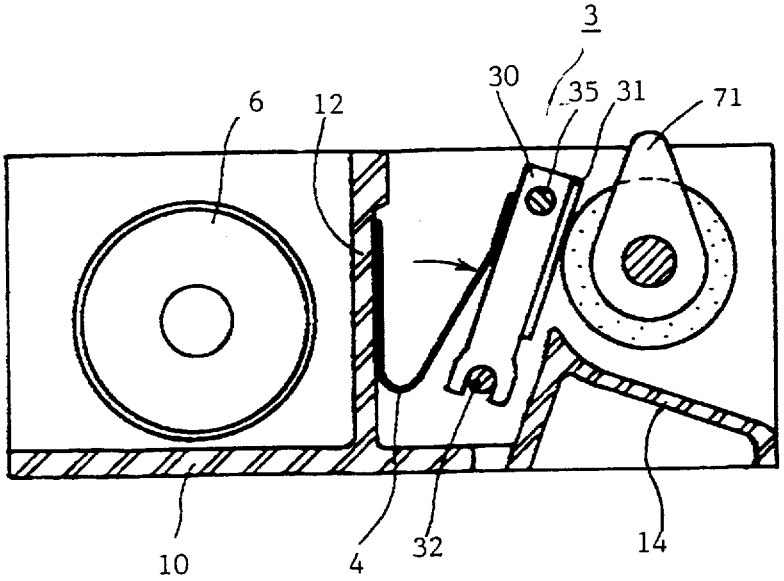
FIG. 9A PRIOR ART
FIG. 9A and FIG. 9B are cross-sectional diagrams, respectively showing the head-down and head-up states of a thermal head in the prior art thermal printer.
Figure 9B:
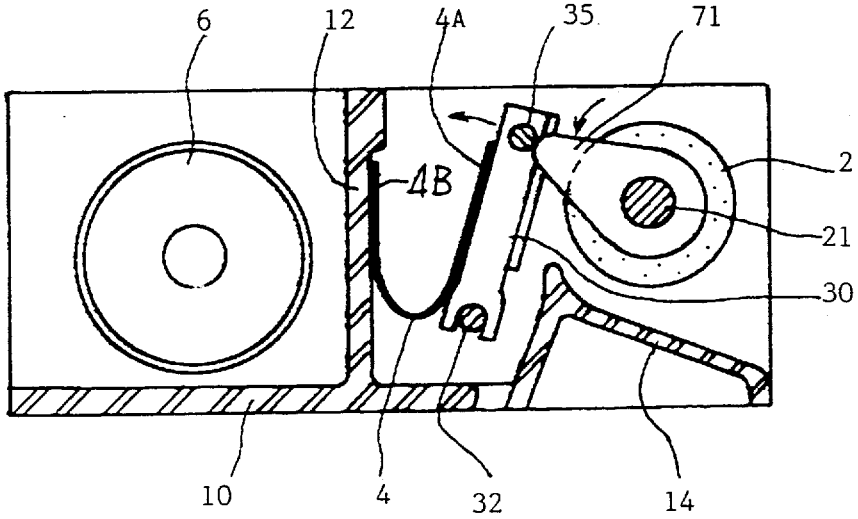
FIG. 9B PRIOR ART

As a result, there is no pressure or resilience of the elastic member 4 applied to the chassis 10 such as with the prior art thermal printer described with reference to FIG. 8 and FIG. 9, and therefore, the chassis 10 is relieved of the problem of twisting due to these forces. According to the present invention, there is no need to provide an inner wall 12, and the required strength of the chassis 10 can be reduced. This means that the thickness of the walls of the chassis 10 can be reduced even further. Consequently, miniaturization and lightening of the thermal printer can be realized, and problems of irregular printing due to twisting of the chassis 10 can be done away with.

The strength required of the arm members 41 and 42 is that the members be sufficiently strong to withstand the pulling force corresponding with the pressure and resilience (i.e., resilient force) of the elastic member 4, the strength required of the bar member 45 is that it be sufficiently strong to withstand the forementioned resilience, and either can be prepared using metal plate material and metal rod material. According to the present invention, a construction of a cantilever beam may be used instead, wherein only one of the arm members 41 or 42 is provided, and a bar member 45 shorter than that in the above embodiment is linked to the second portion of this arm member.

Both of the arm members 41 and 42 or one of the arm members 41 or 42 may be positioned within the chassis 10 or the exterior thereof. In the event of providing to the exterior, holes are provided to the side walls 11 corresponding with the arm members 41 and 42 for the bar member 45 to pass through.

As described above, there are cases where it is necessary to remove the printing head from contact with the platen temporarily or for long periods of time, in order to replace paper or the printing head, or to prevent deforming of the platen due to the printing head. In the present invention, a function is provided to relieve the bar member 45, for example, from pressure of the elastic member 4 by means of separation from contact with the elastic member 4. Several methods for realizing this function are described below.

Figure 3:
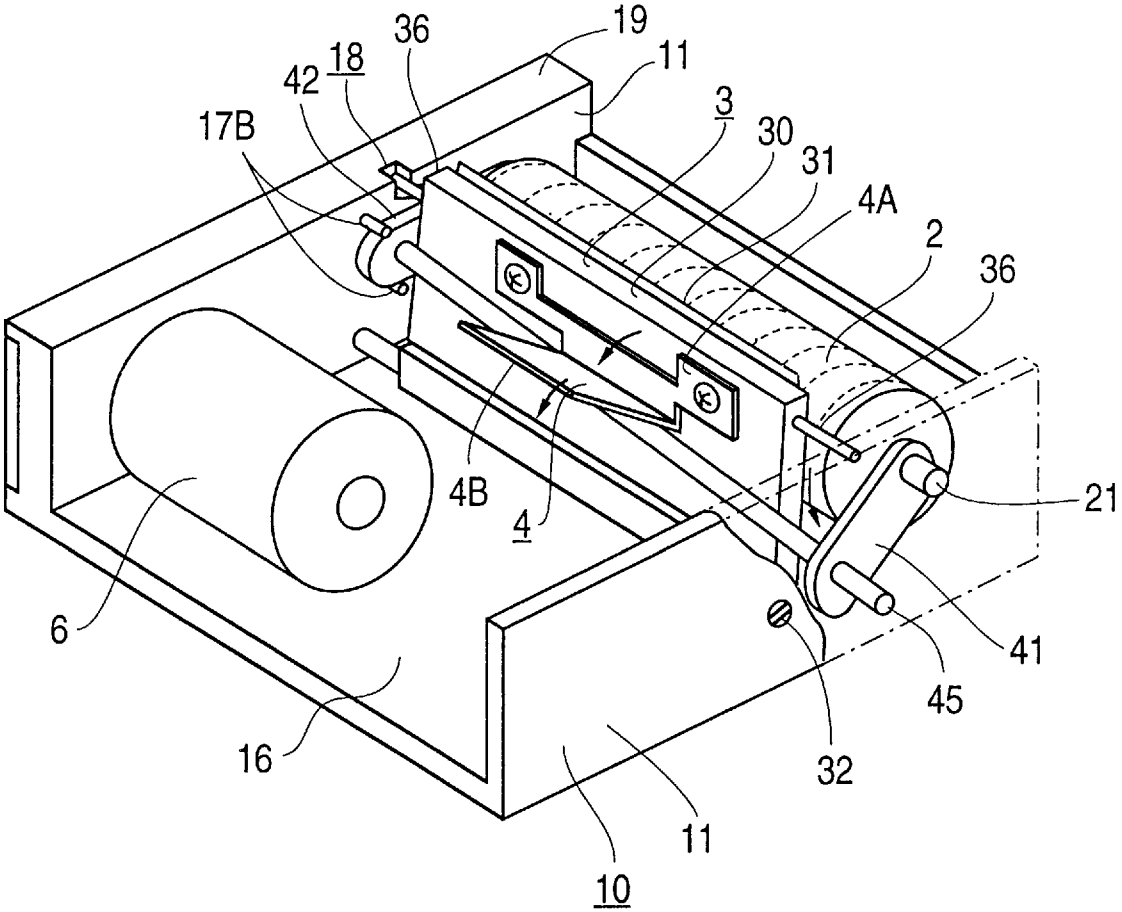
FIG. 3 is an overall perspective view for describing a second embodiment of the present invention.

FIG. 3 is an overall perspective view of a thermal printer for describing a first embodiment of this method. Through holes for rotatable fitting the shaft 21 of the platen 2 are provided in respective first ends of the aforementioned pair of arm members 41 and 42. Accordingly, the arm members 41 and 42 and the bar member 45 linked thereto are rotatable around the shaft 21. When the either or both of the arm members 41 and 42 are rotated, the bar member 45 is removed (i.e., displaced) from contact with the end 4B of the elastic member 4. In FIG. 3, the arm member 41 alone is rotated in the downward direction, i.e., toward the bottom 16 of the chassis 10. The other arm member 41 is fixed by two protrusions 17B provided at the adjacent side wall 11 of the chassis 10.

As a result, the bar member 45 is relieved from the resilience (i.e., the resilient force) of the elastic member 4, and on the other hand, the printing head 3 does not receive pressure from the elastic member 4. In this state, the print head 3 becomes easily rotatable around the supporting shaft 32, and is removed from contact with the platen 2. Accordingly, even if a head-up state is maintained for long periods of time, there is no permanent warping of the chassis 10 as with the prior art thermal printer. Also, the great force for raising the head up, i.e., the force for overcoming the pressure of the spring member 4, necessary with the prior art thermal printer is not needed. As a result, the thermal head 3 can be easily removed from the chassis 10 and replaced.

Figure 2A:
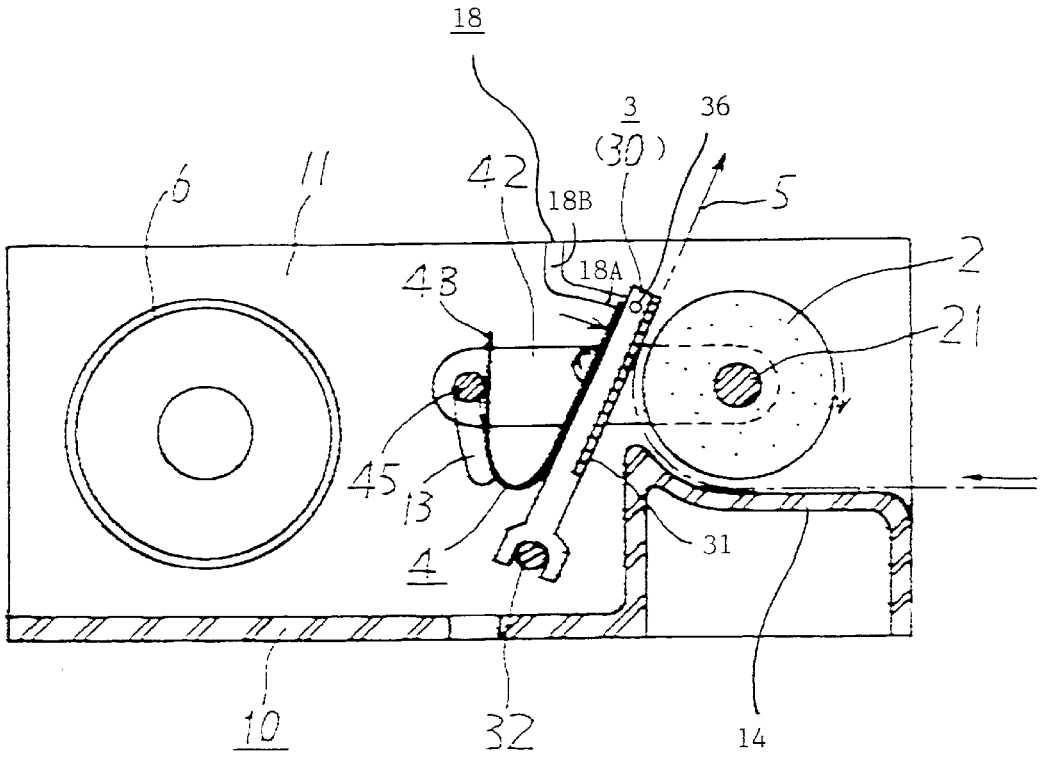
FIG. 2A and FIG. 2B are cross-sectional diagrams, respectively showing the head-down and head-up states of the thermal head in the embodiment shown in FIG. 1.
Figure 2B:
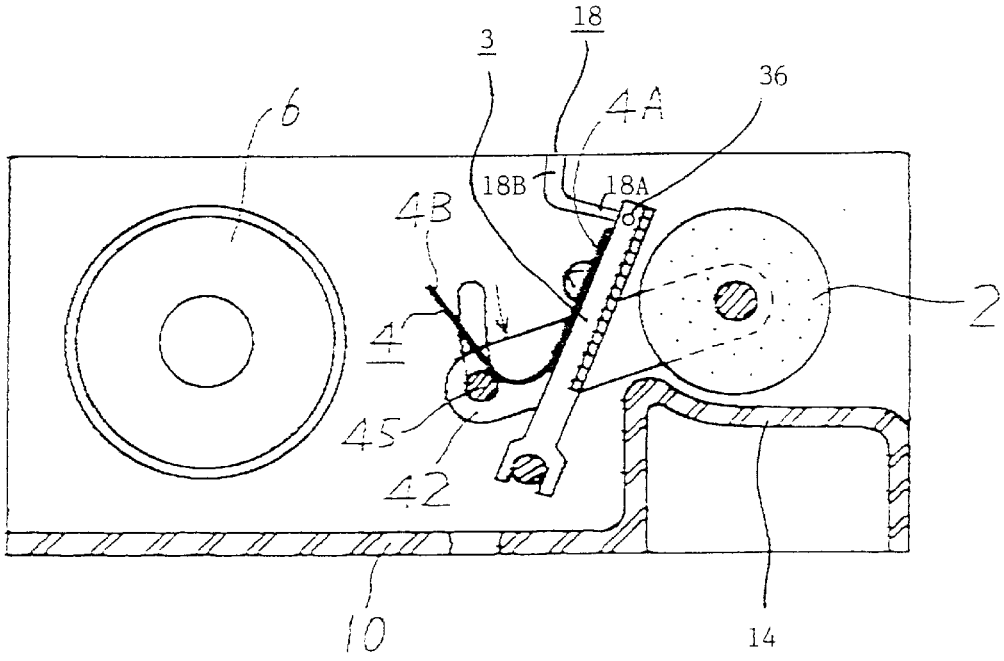

As described above, in the event of providing either one or both of the arm members 41 and 42 at the exterior of the chassis 10, through holes are provided in the side walls 11 corresponding to the arm members 41 and 42, to allow for passage of the bar member 45 therethrough, and also allow for movement of the bar member 45 upon rotation of the arm members 41 or 42 around the shaft 21 of the platen 2. As an example of this, FIG. 1, FIG. 2A and FIG. 2B illustrate am arc-shaped through hole 13 corresponding with the movement of the bar member 45. In the event that the arm members 41 and 42 are top be provided within the chassis 10, a similar arc-shaped groove may be provided on the inner plane of the side walls 11 as a guide instead of the through hole 13.

As described above, in the structure wherein the bar member 45 is made to be disengaged from contact with the elastic member 4 by means of rotation of the arm members 41 or 42, means for temporarily fixing the bar member 45 are necessary, for stably maintaining the thermal head 3 in a head-down state, or position.

In order to simplify a description, for example, with reference to FIG. 2B, in the state that an elastic member 4 comprised of a sheet spring is pressing a thermal head 3, the form of the aforementioned sheet spring is designed such that the angle between the line which passes through the point of contact of the elastic member 4 and the bar member 45 and is perpendicular to the bar member 45 and the line connecting the centers of the bar member 45 and the shaft 21 of the platen 2 is an angle smaller than 90° on the other end side 4B of the of the elastic member 4. At the same time, it is preferable that the through hole or groove provided in the side wall 11 for movement of the bar member 45 be designed such that the inner wall of the through hole or the end of the groove comprises the terminal point of movement of the bar member 45. As separate means, a structure can also be used wherein, in the state that an elastic member 4 comprised of a sheet spring or coil spring is pressing the thermal head 3, a hollow is formed into which the bar member 45 temporarily falls at the position where this sheet spring or coil spring comes into contact with the bar member 45.

Figure 4A:
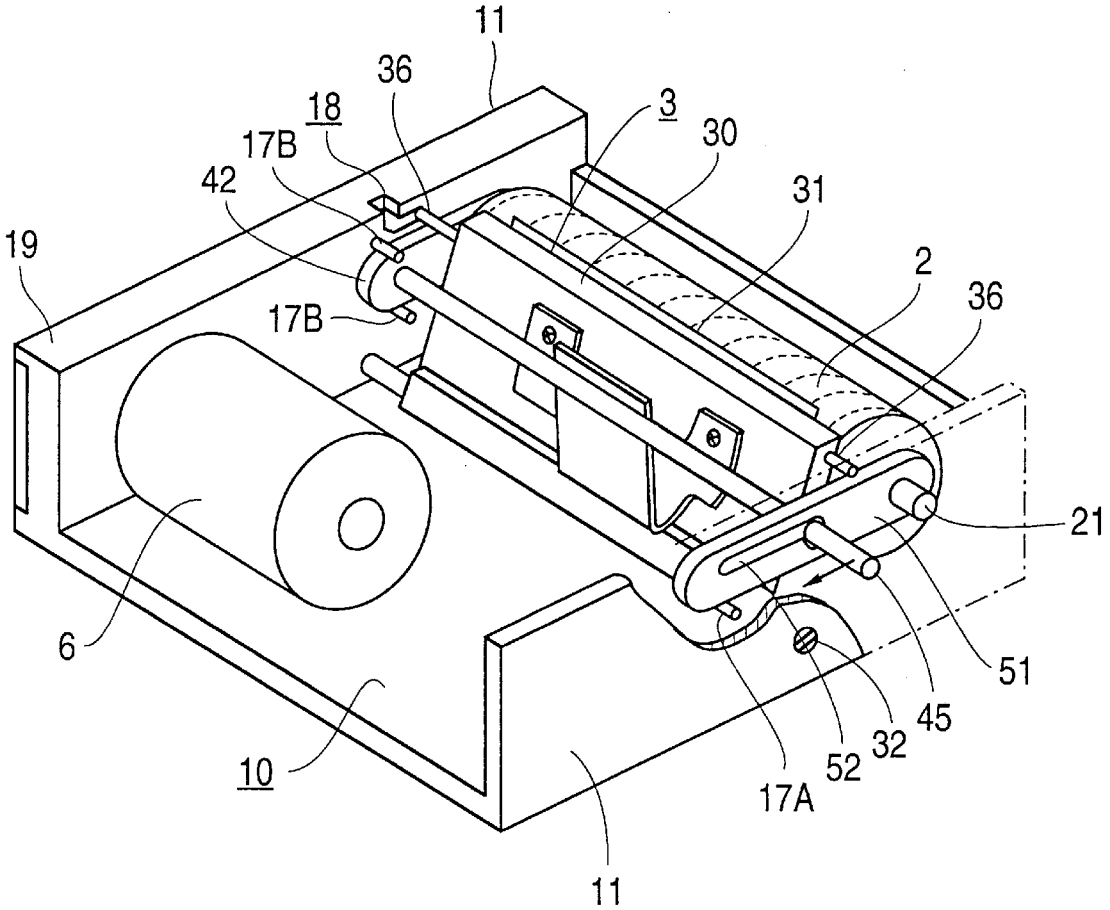
FIG. 4A and FIG. 4B are respectively an overall perspective view for describing a third embodiment of the present invention and a frontal diagram of an arm member.
Figure 4B:
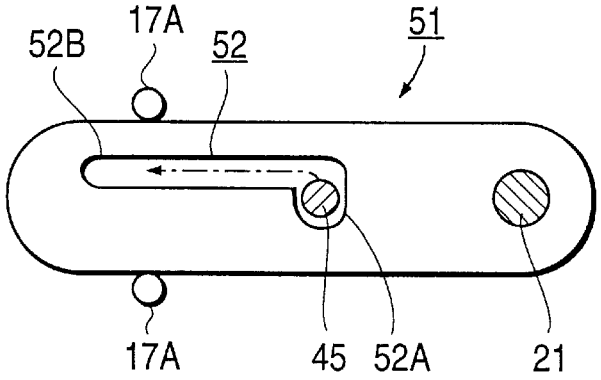

FIG. 4A and FIG. 4B are a perspective view and a partial enlarged side view of a second embodiment for removing the bar member 45 from contact with the elastic member 4. For example, one arm member 51 has an extended portion, and is longer than the other arm member 42; i.e., with reference to FIG. 4B, regarding the arm member 51, the length between the hole through which the shaft 21 of the platen 2 passes and the position where the bar member 45 is located is the same as the corresponding length of the other arm member 42. The arm member 51 has a portion extending further (extended) from, or beyond, the position where the bar member 45 is located, and a guide groove 52 is provided in this extended portion through which the bar member 45 can slide, in the direction indicated by an arrow. On one end 52A of the guide groove 52, a notch is formed which extends sideways (i.e., transversely) from the guide groove 52. In the Figure, the bar member 45 has dropped into this notch, and is temporarily fixed therein. In this position, the bar member 45 comes into contact with the elastic member 4, the elastic member 4 presses against the thermal head 3, and the bar member 45 receives a resilient force from the elastic member 4. The bar member 45 is removed from the elastic member 4 by being removed from the aforementioned notch and moved to the other end 52B of the guide groove 52. Consequently, the thermal head 3 is disengaged from the resilient pressure a force of the elastic member 4, and the bar member 45 does not receive the resilient force from the elastic member 4.

In the present embodiment, both arm members 42 and 51 do not need to rotate around the shaft 21 of the platen 2. Accordingly, as shown in FIG. 4A, both arm members 42 and 51 may be fixed by protrusions 17B provided at the corresponding side walls 11. In the event that the arm member 51 is to be situated on the inner side of the corresponding side wall 11, a carved groove may be provided on the inner side of this side wall 11 in which the bar member 45 slidably fits. The arm member 42 may be replaced with a member provided with an extended portion and a guide groove, like groove 52. In the event of providing the arm member 51 to the exterior of the side wall 11, through holes are provided to the side walls 11 corresponding to the arm member 51, to allow for passage of the bar member 45 which slides in the forementioned guide groove 52.

Figure 5:
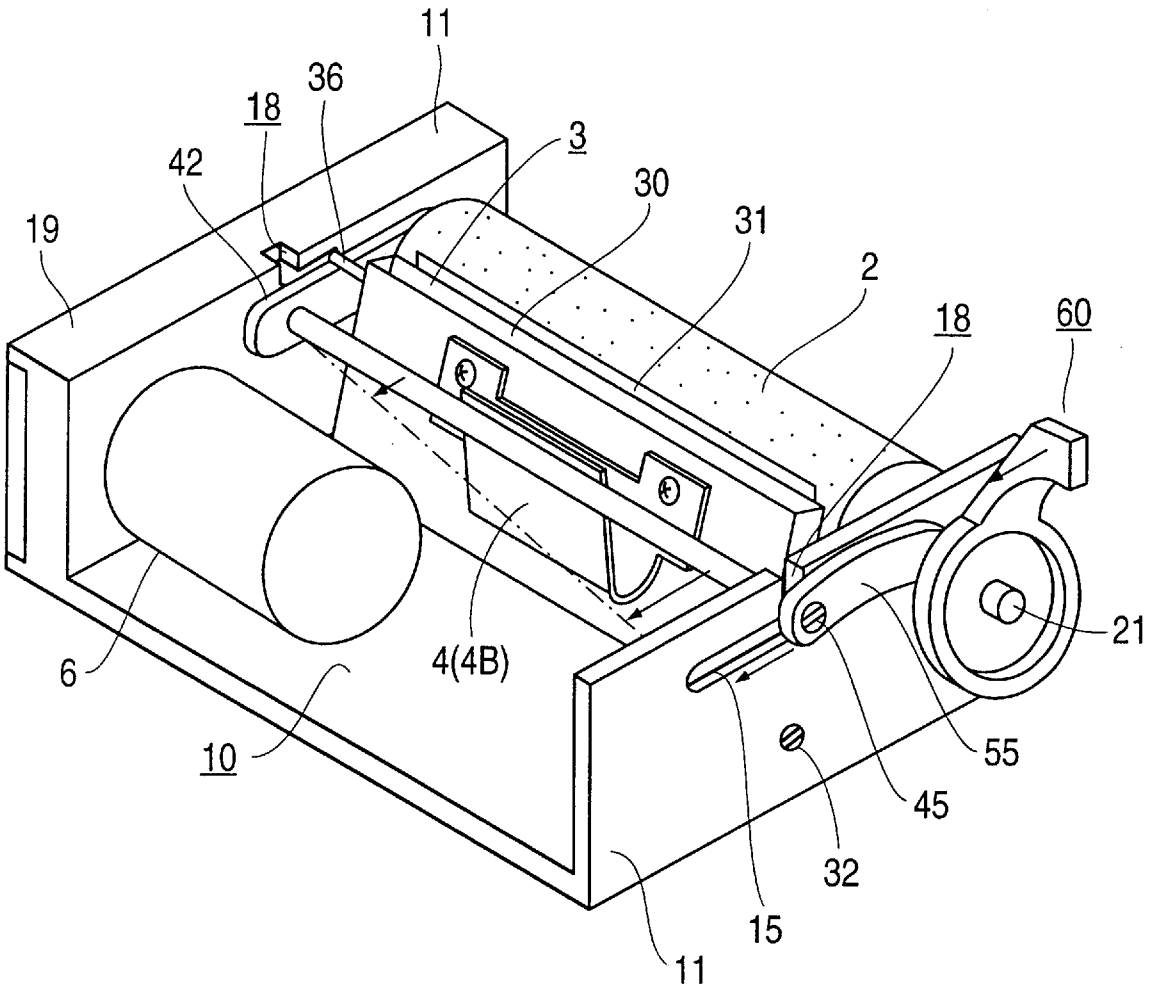
FIG. 5 is an overall perspective view for describing a fourth embodiment of the present invention.

Another embodiment for removing the bar member 45 from the elastic member 4 will now be described with reference to the perspective view of FIG. 5 and the partial enlarged side views of FIG. 6A through FIG. 6C. One end of the arm member 55 is rotatable linked to an operating pin 65 of the crank mechanism 60 which is rotatable around the shaft 21 of the platen 2. The bar member 45 is linked to the other end of the arm member 55. The arrangement wherein the one end of the bar member 45 is connected to the other arm member 42 is the same as with the previous embodiment. In FIG. 5, the arm member 55 and the crank mechanism 60 are situated on the outer side of the corresponding side wall 11, and a straight guide groove 15 is provided in this side wall 11, in which the bar member 45 is slidable.

For example, rotating the crank mechanism 60 with the lever 62 fixed to the crank mechanism 60 changes the distance between the bar member 45 and the shaft 21 of the platen 2, and as a result, the bar member 45 performs reciprocal movement within the guide groove 15. When this distance is minimal, the bar member 45 comes into contact with the elastic member 4, and pressure is applied to the thermal head 3. On the other hand, when this distance is maximal (i.e., greatest), the bar member 45 is relieved from contact with the elastic member 4, and consequently, the thermal head 3 is removed from receiving pressure from the elastic member 4, and the bar member 45 does not receive any resilient force from the elastic member 4.

Figure 6A:
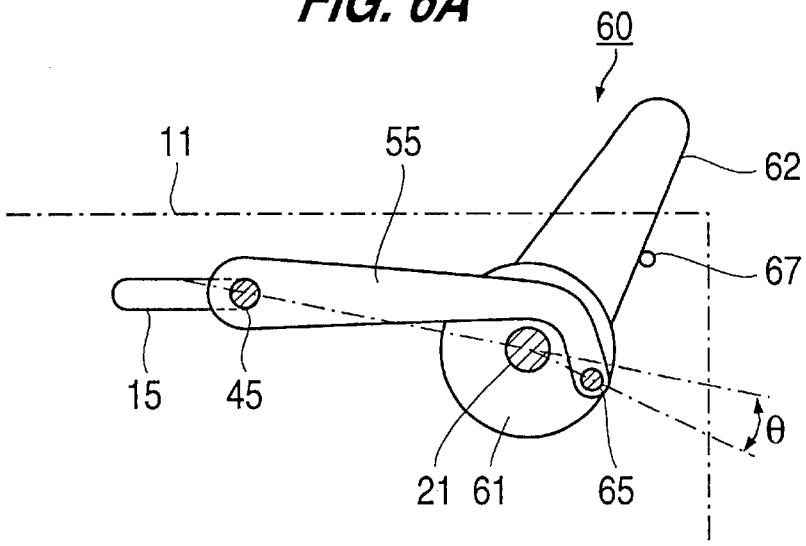
FIG. 6A, 6B, and FIG. 6C are partial side-view diagrams for describing the crank mechanism 60 in the fourth embodiment, respectively showing the head-down and head-up states of the thermal head, and an altered example.
Figure 6B:
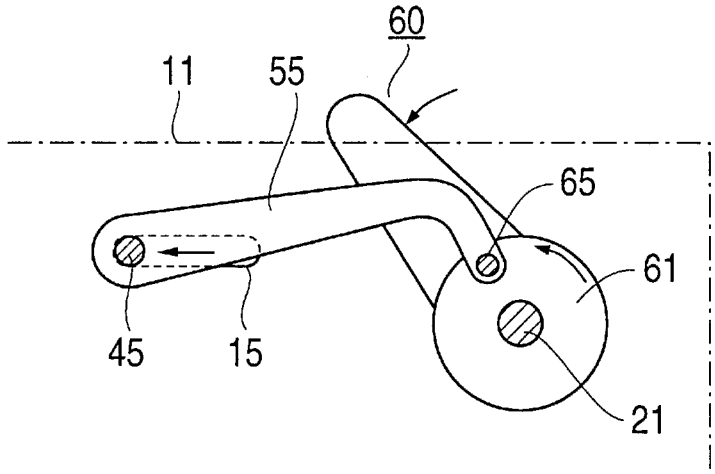

When the crank mechanism 60 is rotated in a clockwise direction in FIG. 6A and the operating pin 65 reaches a line which connects the shaft 21 of the platen 2 and the bar member 45, the distance between the shaft 21 and the bar member 45 is minimal. Generally, in this state, the pressure of the elastic member 4 applied to the thermal head 3 (both omitted in the drawing) is maximum. In the state that the crank mechanism 60 is further rotated from the line which connects the shaft 21 of the platen 2 and the bar member 45 by an angle θ, the bar member 45 attempts to move backwards, i.e., toward the left direction in the Figure, due to the resilient force from the elastic member 4. As a result, the crank mechanism 60 further attempts to rotate in the clockwise direction. In this state, if a stopper 67 coming into contact with the lever 62 is provided in the side wall 11 of the chassis 10, additional rotation due to the above resilient force can be prevented. Thus, the head-down of the thermal head 3 is maintained. Accordingly, as described with reference to the embodiment illustrated in FIG. 3, no special means for maintaining the thermal head in a head-down position needs to be given to the design of the elastic member 4.

By rotating the crank mechanism 60 in the counter-clockwise direction from the above-described state, the operating pin 65 crosses the line which connects the shaft 21 and the bar member 45. At this time, the pressure of the elastic member 4 to the thermal head 3 (both omitted in the drawing) becomes maximum again. Further rotating the crank mechanism 60 reduces the pressure. When the crank mechanism 60 has been rotated to the point that the distance between the shaft 21 and the bar member 45 is maximal, the pressure becomes substantially zero. i.e., the thermal head 3 may be placed in a head-up state.

The method according to the present embodiment allows achieving the head-up and head-down positioning of the thermal head 3 easily and with little force, due to using the lever 62 for operation thereof.

Figure 6C:
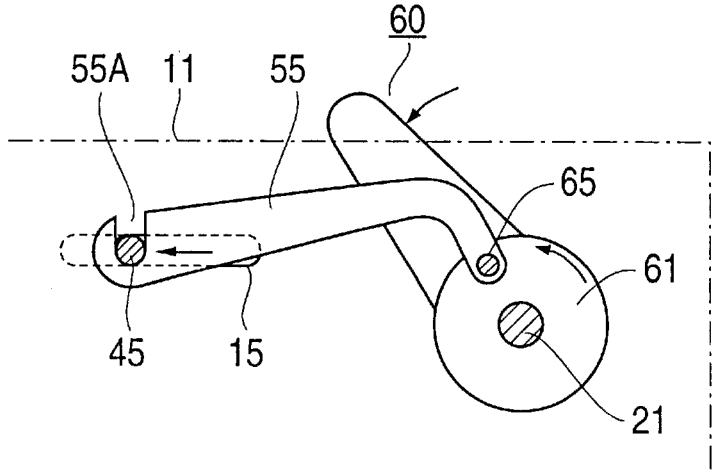

FIG. 6C illustrates an altered example of the above embodiment, wherein a notch 55A is formed of a portion of a circle which has the operating pin 65 as the center thereof and has the distance between the bar member 45 and the operating pin 65 as the radius thereof, the notch being situated at the first position of the arm member 55. As shown in FIG. 6B, in the state that the distance between the shaft 21 and the bar member 45 is maximal, thereby relieving the bar member 45 from resilience of the elastic member 4 (both omitted in the drawing), rotating the arm member 55 in the counter-clockwise direction in the Figure around the operating pin 65 causes the bar member 45 to move relatively within the notch 55A, and be removed from the arm member 55. The bar member 45 in this state then further becomes movable in the left direction in the Figure, following the guide groove 15 formed in the side wall 11, for example. Accordingly, the distance between the bar member 45 and the elastic member 4 becomes sufficiently great, thereby facilitating replacement of the thermal head 3 (omitted in the Figure).

Figure 7A:
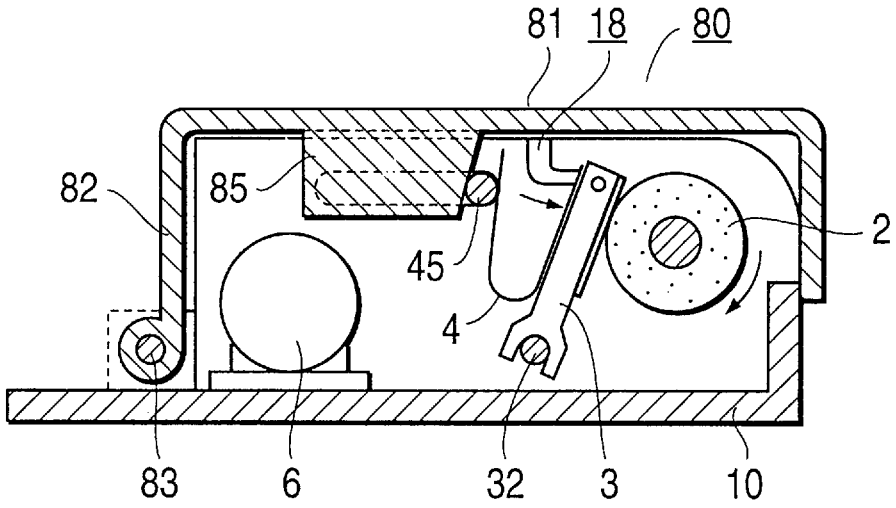
FIG. 7A and FIG. 7B are cross-sectional views of a fifth embodiment of the present invention, respectively showing the head-down and head-up states of the thermal head.
Figure 7B:
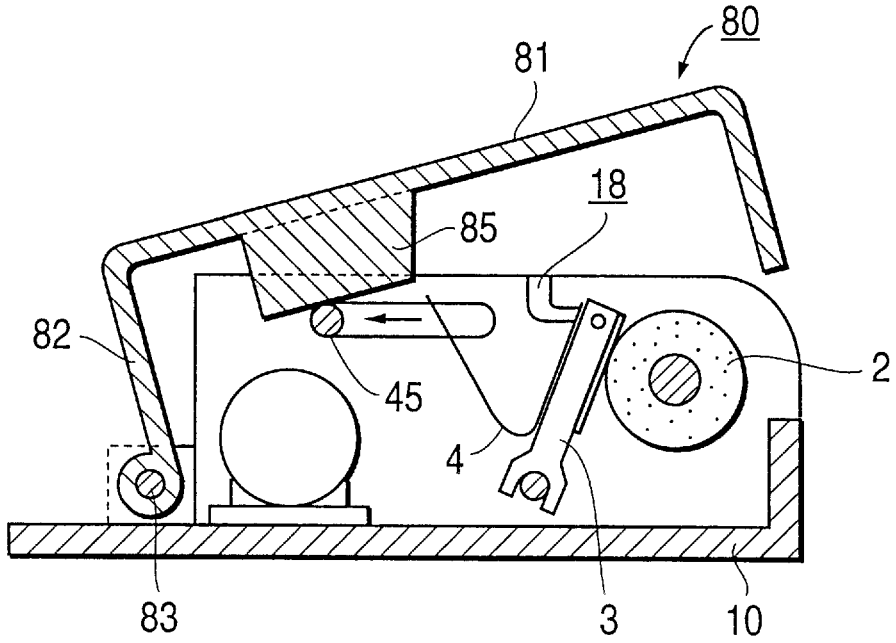

The fifth embodiment illustrated in FIGS. 7A and 7B is a structure wherein a cover 80 has been provided for the chassis 10. The cover 80 is comprised of a top plate 81, and a protruding plate 85 formed on the inner side of the top plate 81, and is rotatably supported by a hinge 83 fixed to the aforementioned side wall 11 of the chassis 10 or the bottom thereof. In the event that the thermal head is in the head-down position (i.e., state), i.e., the thermal printer is operating, the cover 80 covers the chassis 10 and protects the members stored within the chassis 10, such as the thermal head 3 and the platen 2 and the like. In the event that the bar member 45 is in contact with the elastic member 4 for placing the thermal head 3 in the head-down position (i.e., state), the protruding plate 85 either does not come into contact with the bar member 45, or comes into contact with the bar member 45 on the side thereof. Accordingly, the cover 80 can be rotated so as to completely cover the chassis 10. On the other hand, with the construction shown in FIG. 5, in the case wherein the bar member 45 is moved to the left in the Figure along the guide groove for placing the thermal head 3 in the head-up position (i.e., state), the protruding plate 85 is stopped by the bar member 45 to the lower plane thereof, and cannot cover the chassis 10 entirely. Accordingly, the operator can recognize that the thermal head is up by the cover 80 being open, thus preventing accidental incorrect operation of the thermal printer.

Figure 10:
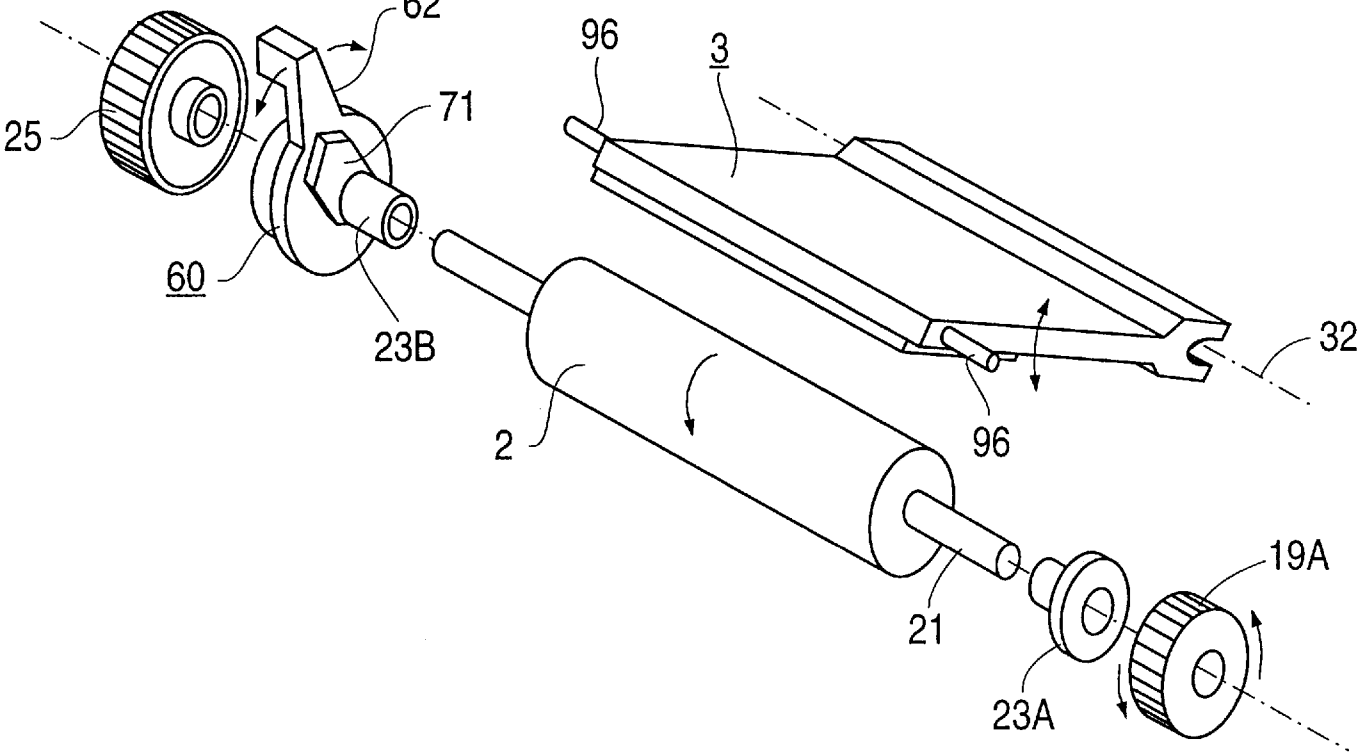
FIG. 10 is a disassembled perspective view illustrating the detailed structure of a bearing for the platen in the thermal printer according to the present invention.

FIG. 10 illustrates the bearing structure of the platen 2 employed in the thermal printer according to the present invention. The shaft 21 of the platen 2 rotatable fits the bearings 23A and b provided respectively to both the side walls 11 (not shown) of the chassis 10. One edge of the shaft 21 protrudes through the bearing 23A and is linked to the center of the gear 19A. The gear 19A is stored within the gear box 19 (e.g., see FIG. 1) and is rotatable driven by the motor 6. The other end of the shaft 21 protrudes through the bearing 23B, and a knob 25 is provided on the tip thereof. The knob 25 is used for manually rotating the platen 2, when replacing paper.

As shown in FIG. 10, the bearing 23B may be integrally formed with the crank mechanism 60 illustrated in FIG. 5. Further, the cam 71, which comes in contact with the pin 96 provided on the thermal head 3 when performing head-up operation of the thermal head 3, may be provided with to the crank mechanism 60. The cam 71 comes into contact with the pin 36, and can forcibly create a gap between the platen 2 and the thermal head 3.

What is claimed is:

1. A thermal printer comprising:

a chassis having a base and a pair of side walls secured to said base, said side walls facing each other with a gap therebetween;

a platen disposed in the gap and having a shaft which is rotatably supported by said side walls;

a print head having a front surface facing said platen and a rear surface opposite to said front surface, said print head being pivotally supported by a supporting means;

an elastic member applying a resilient force to said print head for moving said front surface of said print head into contact with said platen at a pressure, said elastic member having a first end contacting said rear surface of said print head and a second end opposite to said first end; and means for receiving the resilient force of said elastic member, said means being separated from said side walls, linked with said shaft of said platen so as to be supported thereby, and having a portion extending into contact with said second end of said elastic member for receiving said resilient force thereof.

2. A thermal printer as set forth in claim 1, wherein said print head comprises an array of heat-generating elements disposed on said front surface of said print head and in parallel to said shaft of said platen.

3. A thermal printer as set forth in claim 1, wherein said print head comprises a plate member formed of a thermal conductive material and said front and rear surfaces of said print head are defined on said plate member.

4. A thermal printer as set forth in claim 1, wherein said first end of said elastic member is secured to said rear surface of said print head.

5. A thermal printer as set forth in claim 1, wherein said elastic member comprises a U-shaped sheet-spring having said first and second ends.

6. A thermal printer as set forth in claim 1, said resilience receiving means comprising:

a pair of arm members respectively disposed at opposite ends of said platen, one each along said shaft, each of said pair of arm members including a first end portion having a through-hole therein for linking said arm member with said shaft and rotatably engaging said shaft therein and a second end portion opposite to said first end portion; and a bar member disposed so as to extend between said pair of arm members and be linked at opposite ends thereof with respective said second end portions of said arm members and so as to be contacted by said second end of said elastic member and receive the resilient force of said elastic member.

7. A thermal printer as set forth in claim 6, wherein said supporting means allows said printing head to pivotally and removably ride thereon, said thermal printer further comprising:

a pair of protrusions extending from respective, opposite sides of said print head, in parallel to, and spaced apart from, said supporting shaft; and a pair of guide-and-stop grooves formed in said side walls, respectively, corresponding to respective ones of said pair of protrusions and said corresponding said protrusions being engaged therein, each of said guide-and-stop grooves having a circular-arc groove part and a straight groove part connected with said circular-arc groove part, each said circular-arc groove part allowing said corresponding protrusion to slidably move therein when said print head is pivotally moved with respect to said supporting means for contacting with said platen, and each said straight groove part allowing said corresponding protrusion to slidably move therein so that said print head is removable from said chassis.

8. A thermal printer as set forth in claim 6, wherein at least one of said arm members is rotatable with respect to said shaft of said platen thereby to release said bar member from contact with said second end of said elastic member by rotating said at least one arm member with respect to said shaft of said platen.

9. A thermal printer as set forth in claim 8, wherein a guide groove is formed in a selected said side wall of said chassis, which selected side wall corresponds to said at least one arm member, said guide groove having a curvature corresponding to the travel path of said second end portion of said at least one arm member when rotating with respect to said shaft of said platen, and allowing said bar member to slidably move therein.

10. A thermal printer as set forth in claim 6, wherein a guide groove is formed in said second end portion of at least one of said arm members, said guide groove longitudinally extending in a direction opposite to said corresponding first end portion and allowing said bar member to slidably move therein, whereby said bar member is released from contact with said second end of said elastic member when moved in said guide groove in said direction.

11. A thermal printer as set forth in claim 10, wherein said at least one arm member is disposed outside said side walls of said chassis, and a second guide groove is formed in a corresponding one of said side walls, said second guide groove extending in parallel to said guide groove formed in said second portion of said at least one arm member and allowing said bar member to pass therethrough and slidably move therein.

12. A thermal printer as set forth in claim 10, wherein said at least one arm member is provided with a cut-out extending transversely from said guide groove at an end thereof nearest to said corresponding first end portion, whereby said bar member is maintained in contact with said second end of said elastic member when engaged in said cut-out.

13. A thermal printer as set forth in claim 1, further comprising means for releasing said resilient force receiving means from contact with said second end of said elastic member so that said platen and said front surface of said print head are released from contact with each other.

14. A thermal printer as set forth in claim 1, said resilient force receiving means comprising;

a first arm member;

a set of a second arm member and a crank member; and a bar member, wherein:

each of said first and second arm members has a first end portion in which a through-hole is formed and a second end portion opposite to said first end portion, and said crank member has a rotation center portion in which a through-hole is formed, and has a working pin formed at a position thereof apart from said rotation center portion and revolving around said rotation center portion, and wherein said first arm member and said crank member are disposed at respective, opposite sides of said platen, along said shaft of said platen and such that said first arm member and said crank member are linked with said shaft, allowing said shaft to rotatably engage in respective said through-holes of said first arm member and said crank member, and said second arm member links with said crank member through said through-hole formed in said first end portion thereof by allowing said working pin of said crank member to rotatable engage therein, said bar member is disposed between said first and second arm members and linked with respective said second end portions of said first and second arm members, and the distance between said second end portion of said second arm member and said rotation center portion of said crank member is changed by rotating said crank member with respect to said shaft of said platen, for selectively rendering said bar member in contact with or separated from said second end of said elastic member.

15. A thermal printer as set forth in claim 14, wherein said bar member is separated from said second portion of said elastic member when a distance, between said second end portion of said second arm member and said rotation center portion of said crank members, becomes a maximum.

16. A thermal printer as set forth in claim 14, further comprising a cut-out portion formed in said second end portion of said second arm member for releasing said bar member from linking with said second end portion of said second arm member by rotating said second arm member with respect to said working pin of said crank member.

17. A thermal printer as set forth in claim 14, wherein said supporting means allowing said printing head to pivotally and removably ride thereon, said thermal printer further comprising:

a pair of protrusions extending from respective, opposite sides of said print head, in parallel to, and spaced apart from, said supporting shaft; and a pair of guide-and-stop grooves formed in respective said side walls and each corresponding to a respective one of said protrusions and engaging to said corresponding protrusion therein, each of said guide-and-stop grooves having a circular-arc groove part and a straight groove part connected with said circular-arc groove part, each said circular-arc groove part allowing said corresponding protrusion to slidably move therein when said print head is pivotally moved with respect to said supporting means for contacting with said platen, and said straight groove part allowing corresponding one said protrusion to slidably move therein so that said print head is removed from said chassis.

18. A thermal printer as set forth in claim 14, wherein said crank member is revolvable with respect to said shaft of said platen such that said working pin moves across the line connecting said rotation center portion of said crank member and said second end portion of said second arm member during the change in the distance between said second end portion of said second arm member and said rotation center portion of said crank member.

19. A thermal printer as set forth in claim 6, further comprising a lid for covering said chassis, said lid being rotatably supported by a shaft of a hinge secured to said base of said chassis at a position opposite to said printing head with respect to said bar member, said shaft of said hinge being disposed in parallel to said shaft of said platen, wherein said lid has a protrusion formed on the inner surface thereof, said protrusion having a side surface and a bottom surface and being of a size such that, when said bar member is in contact with said second end of said elastic member, said lid is allowed to rotate up to a lowest position for covering said chassis because said side surface of said protrusion faces said bar member, and when said bar member is removed from contacting with said second end of said elastic member, said lid is interrupted to rotate up to the lowest position by said protrusion which is in contact with said bar member through said bottom surface thereof.

20. A thermal printer as set forth in claim 14, further comprising a lid for covering said chassis, said lid being rotatably supported by a shaft of a hinge secured to said base of said chassis at a position opposite to said printing head with respect to said bar member, said shaft of said hinge being disposed in parallel to said shaft of said platen, wherein said lid has a protrusion formed on the inner surface thereof, said protrusion having a side surface and a bottom surface and being of a size such that, when said bar member is in contact with said second end of said elastic member, said lid is allowed to rotate up to a lowest position for covering said chassis because said side surface of said protrusion faces said bar member, and when said bar member is removed from contacting with said second end of said elastic member, said lid is interrupted to rotate up to the lowest position by said protrusion which is in contact with said bar member through said bottom surface thereof.

21. A printer, comprising:

a housing;

a platen mounted on a shaft, the shaft defining a first axis and having first and second opposite ends rotatably supported by the housing;

a print head supported by the housing and mounted for rotation about a second axis, parallel to the first axis, between a first position displaced from the platen and a second position contacting the platen;

an elastic element; and a link mechanism coupled to the shaft of the platen and supporting a bar, the link mechanism affording selective movement of the bar between a retracted position remote from the platen and an active position adjacent the platen and, in the active position of the bar, the resilient force of the elastic element being exerted between the bar and the print head and correspondingly between the link mechanism and the shaft, substantially independently of the housing.

22. A printer as recited in claim 21, wherein the bar, in the active position thereof, is parallel to the first and second axes.

23. A printer as recited in claim 22, wherein the link mechanism is coupled to the shaft of the platen and affords selective movement of the bar by rotation of the bar about the first axis defined by the shaft of the platen.

24. A thermal printer, comprising:

a housing;

a platen mounted on a shaft, the shaft supported by the housing and defining a first axis about which the platen is rotatable;

a print head supported by the housing and mounted for rotation about a second axis parallel to and spaced by a fixed distance from the first axis;

a print head actuator comprising a link mechanism having a first end coupled to the shaft and a second end displaced from the surface of the platen and defining a corresponding space therebetween through which the print head extends and is rotatable, and a resilient element interconnecting the second end of the actuator and the print head, the actuator imposing a resilient force through the resilient element against the print head for resiliently engaging the print head against the platen, the resilient force of the elastic element being exerted between the bar and the print head and correspondingly between the link mechanism and the shaft, substantially independently of the housing.

25. A printer as recited in claim 24, wherein the link mechanism further comprises first and second links having respective first ends coupled to corresponding, opposite ends of the platen shaft and respective second ends and a bar received at opposite ends thereof in engaging portions of the first and second links adjacent the respective second ends thereof, the bar engaging the resilient element and being movable from a position remote from the platen surface to an active position, closer to the platen surface, for exerting a resilient force through the resilient element to the print head.

26. A printer as recited in claim 24, wherein the bar, in the active position thereof, is parallel to the first and second axes.

27. A printer as recited in claim 26, wherein the link mechanism is coupled to the shaft of the platen and affords selective movement of the bar by rotation of the bar about the first axis defined by the shaft of the platen.

* * * * *

UNITED STATES PATENT AND TRADEMARK OFFICE

CERTIFICATE OF CORRECTION

PATENT NO. : 5,846,003

DATED : December 8, 1998

INVENTOR(S) : Yukihiro MORI et al.

It is certified that error appears in the above-identified patent and that said Letters Patent is hereby corrected as shown below:

On the title page, [75] Inventors, line 2, change "Netherlands" to --The Netherlands--.

On the title page, [56] Other Publications, line 6, change "toshiba" to --Toshiba--.

Col. 4, line 36, change "on" to --in--.

Col. 5, line 42, change "for describing the" to --illustrating a--.

Col. 8, line 53, change "am" to --an--;
line 56, change "top" to --to--.

Col. 9, line 8, delete "of the" (second occurrence);
line 44, change "a" to --or--.

UNITED STATES PATENT AND TRADEMARK OFFICE

CERTIFICATE OF CORRECTION

PATENT NO. : 5,846,003

DATED : December 8,1998

INVENTOR(S) : Yukihiro MORI et al.

It is certified that error appears in the above-identified patent and that said Letters Patent is hereby corrected as shown below:

Col. 10, line 55, change "." to --,--.

Col. 13, line 40, change ";" to --:--;
line 62, change "rotatable" to --rotatably--.

Col. 14, line 10, change "members" to --member--.

Signed and Sealed this

Thirteenth Day of July, 1999

*Attest:*

*Attesting Officer*

Q. TODD DICKINSON

*Acting Commissioner of Patents and Trademarks*